US005837664A

United States Patent [19]

Black

[11] Patent Number: 5,837,664

[45] Date of Patent: Nov. 17, 1998

[54] AQUEOUS SHOWER RINSING COMPOSITION AND A METHOD FOR KEEPING SHOWERS CLEAN

[76] Inventor: Robert H. Black, 4858 Mariner Point, Jacksonville, Fla. 32225

[21] Appl. No.: 683,052

[22] Filed: Jul. 16, 1996

[51] Int. Cl.[6] ..... C11D 1/08; C11D 3/08; C11D 3/44

[52] U.S. Cl. ..... 510/238; 510/191; 510/199; 510/362; 510/384; 510/391; 510/504; 134/26

[58] Field of Search ..... 510/191, 199, 510/238, 362, 384, 391, 504; 134/26

[56] References Cited

U.S. PATENT DOCUMENTS

| | | | |
|---|---|---|---|
| 3,553,143 | 1/1971 | Bauer | 252/152 |
| 3,694,365 | 9/1972 | Castner | 252/108 |
| 3,756,950 | 9/1973 | Gluck | 252/8.75 |
| 3,882,038 | 5/1975 | Clayton et al. | 252/164 |
| 3,914,185 | 10/1975 | Inamorato | 252/546 |
| 3,970,595 | 7/1976 | Ginn et al. | 252/545 |
| 3,980,587 | 9/1976 | Sullivan | 252/546 |
| 4,020,016 | 4/1977 | Sokol | 252/546 |
| 4,028,261 | 6/1977 | Petersen et al. | 252/89 R |
| 4,048,121 | 9/1977 | Chang | 252/527 |
| 4,207,215 | 6/1980 | Bolan | 252/542 |
| 4,284,435 | 8/1981 | Fox | 134/2 |
| 4,302,348 | 11/1981 | Requejo | 252/135 |
| 4,343,725 | 8/1982 | Kiewert et al. | 252/542 |
| 4,395,365 | 7/1983 | Hasegawa et al. | 252/545 |
| 4,414,128 | 11/1983 | Goffinet | 252/111 |
| 4,443,270 | 4/1984 | Biard et al. | 134/25.2 |
| 4,455,250 | 6/1984 | Frazier | 252/106 |
| 4,507,219 | 3/1985 | Hughes | 252/118 |
| 4,530,781 | 7/1985 | Gipp | 252/546 |
| 4,559,169 | 12/1985 | Wevers et al. | 252/543 |
| 4,561,998 | 12/1985 | Wertz | 252/547 |
| 4,597,888 | 7/1986 | King | 252/135 |
| 4,678,598 | 7/1987 | Dupre et al. | 252/174.24 |
| 4,749,516 | 6/1988 | Brusky | 252/546 |
| 4,857,213 | 8/1989 | Caswell et al. | 252/8.75 |
| 4,863,629 | 9/1989 | Osberghaus et al. | 252/162 |
| 4,867,898 | 9/1989 | Spaulding et al. | 252/106 |
| 4,954,286 | 9/1990 | Sepulveda et al. | 252/174.22 |
| 5,061,393 | 10/1991 | Linares et al. | 252/143 |
| 5,076,040 | 12/1991 | Rivenaes | 252/548 |
| 5,232,632 | 8/1993 | Woo et al. | 252/546 |
| 5,252,245 | 10/1993 | Garabedian, Jr. et al. | 252/153 |
| 5,342,537 | 8/1994 | Conville et al. | 252/174.24 |
| 5,362,422 | 11/1994 | Masters | 252/544 |
| 5,399,280 | 3/1995 | Woo et al. | 252/142 |
| 5,454,984 | 10/1995 | Graubert et al. | 252/547 |
| 5,503,778 | 4/1996 | Liu et al. | 252/542 |
| 5,536,452 | 7/1996 | Black | 252/238 |
| 5,576,284 | 11/1996 | van Buskirk et al. | 510/384 |
| 5,587,022 | 12/1996 | Black | 134/26 |
| 5,612,308 | 3/1997 | Woo et al. | 510/423 |

FOREIGN PATENT DOCUMENTS

| | | |
|---|---|---|
| 62115833 | 11/1985 | Japan . |
| 63165497 | 12/1986 | Japan . |
| 63-193998 | 7/1987 | Japan . |

*Primary Examiner*—Kery A. Fries
*Attorney, Agent, or Firm*—Browdy and Neimark

[57] ABSTRACT

The invention relates to a composition for an aqueous rinsing solution for removing deposits from surfaces of showers and the like, and the use of such a composition for rinsing showers clean and for providing a pleasant sheen to shower surfaces without scrubbing or wiping. The composition includes a cleaning surfactant, an alcohol, and optionally, a super wetting surfactant, a disinfectant and a base for adjusting pH.

12 Claims, No Drawings

AQUEOUS SHOWER RINSING COMPOSITION AND A METHOD FOR KEEPING SHOWERS CLEAN

BACKGROUND OF THE INVENTION

The invention relates to a rinsing solution composition for keeping showers and the like clean, and a method of using same.

Shower stalls and tubs accumulate a steady build-up of organic and inorganic deposits on their surfaces as a result of repeated use. The accumulation of such deposits, which include insoluble soap curds, washed-off debris from the body partially coated with soap or shampoo, calcium carbonate, other insoluble metal salts, and growth of mildew and microorganisms, etc., creates an unsightly and unhealthy environment that is unacceptable from the standpoint of cleanliness and good hygiene, as well as aesthetics.

Conventionally, the build-up of deposits in a shower can be cleaned with any of a number of aggressive cleaners commercially available to the consumer. These cleaners, which contain combinations of surfactants, chelating agents, oxidizers, abrasives, and soluble salts, require repeated scrubbing or wiping with the cleaner, followed generally with a water rinse, to periodically remove the unsightly and unhealthy build-up in the shower. Considerable labor is required to maintain a clean shower using these conventional cleaners.

At the present time, apart from the aqueous shower rinsing composition disclosed in copending application Ser. No. 08/374,918, issuing as U.S. Pat. No. 5,536,432, and copending application Ser. No. 08/439,382, there is no acceptable product for both maintaining shower surfaces clean and providing a pleasant sheen on shower surfaces without the action of scrubbing or wiping-off of surface deposits.

SUMMARY OF THE INVENTION

An object of the invention is to provide a composition for a shower rinsing solution for cleaning showers and keeping them clean.

Another object of the invention is to provide a method of using the shower and tub rinsing composition to maintain a clean shower, provide a pleasant sheen on the tub and shower surfaces, and prevent the build-up of undesirable deposits on shower surfaces.

The aqueous shower and tub rinsing composition of the present invention offers the distinct advantage of removing deposits from tub and shower surfaces while also providing a pleasant sheen on these surfaces without any immediate rinsing, wiping, scrubbing or the like. The present invention makes use of the water mist formed by subsequent showering to help in the removal of shower deposits in conjunction with the earlier application of the aqueous shower and tub rinsing solution following an earlier showering by the user.

The present invention relates to an easy and safe-to-use, non-streaking aqueous composition, which includes a surfactant capable of chelating metal ions or a surfactant in combination with a chelating agent, an alcohol, and optionally a super wetting surfactant, and/or a disinfectant and/or a base for adjusting pH, for rinsing shower and tub surfaces free from deposits, and without the necessity of wiping or scrubbing.

The present invention also relates to a method of using the aqueous liquid rinsing composition to maintain clean shower and tub surfaces without scrubbing or wiping or even rinsing of the surfaces.

DETAILED DESCRIPTION OF THE EMBODIMENTS

The aqueous shower and tub rinsing composition of the invention includes an alcohol, either an anionic surfactant capable of chelating metal ions or a surfactant in combination with a chelating agent, and optionally a super wetting surfactant, and/or a disinfectant, and/or a base for adjusting pH.

In accordance with the invention, a preferred embodiment of the aqueous shower rinsing solution has the following composition expressed in percent (%) by volume:

| | |
|---|---|
| isopropyl alcohol | 4.4% |
| diammonium salt of N-acyl-N,N'-N'-ethylene diamine triacetic acid | 1.5% |
| N-octyl pyrrolidone | 0.1% |
| fragrance | 0.002% |
| water | balance |

The alcohol, which increases the solvent properties and improves the sheeting action by keeping the surface tension low in order to minimize any residual film on shower surfaces, is added to the aqueous rinsing solution in the range of about 1 to 8% by volume. When the amount of alcohol in the aqueous rinsing solution is above 8%, the alcohol has a stronger, more detectable odor as well as posing a solubility problem with regard to either the anionic surfactant having chelating properties or the chelating agent used in combination with a surfactant. Any short-chain alcohol, such as ethyl alcohol, isopropyl alcohol, n-propyl alcohol, n-butyl alcohol, and isobutyl alcohol, can be used, although isopropyl alcohol is preferred. Ethylene glycol, propylene glycol, glycerol, the isopropyl ether of ethylene glycol, or the ethyl ether of ethylene glycol can be used as possible substitutes for a short-chain alcohol. Methyl alcohol, however, is not recommended due to its toxicity and also its high volatility.

The cleaning surfactant used in the present invention advantageously removes both cationic and anionic surfactant residues and deposits and is preferably a liquid at ambient temperatures. This cleaning surfactant in combination with the alcohol, and optionally, with a super wetting surfactant prevents the appearance of streaking on shower surfaces and provides the desired shine. In general, the aqueous shower rinsing composition contains a total amount of surfactant in the range of about 0.5 to 3% by volume, where the super wetting surfactant, if present, is preferably in a range of 0.5% by volume or less with the balance of the 0.5 to 3% by volume total surfactant being the cleaning surfactant. It has been found that cleaning surfactant concentrations of less than 0.5% by volume did not result in satisfactory removal of shower deposits and that concentrations above 3% left too much residual (observed as a scummy film) on shower surfaces.

N-acyl-N,N',N'-ethylene diamine triacetic acid is an anionic surfactant with chelating properties, e.g., capable of chelating positive metal ions, and a preferred but non-limiting example of a cleaning surfactant present in the aqueous shower rinsing solution according to the present invention. A diammonium salt of N-acyl-N,N',N'-ethylene diamine triacetic acid is available from Hampshire Chemical Corporation, Lexington, Mass. While this preferred cleaning surfactant combines the surfactant and chelating properties into one component of the aqueous shower rinsing composition of the present invention, other cleaning surfactants can instead be used in conjunction with a separate chelating agent to provide both the surfactant and chelating cleaning properties. Non-limiting examples of cleaning surfactants as a component of the aqueous shower rinsing solution of the present invention include: amine oxides including compounds such as lauryldimethylamine oxide, imidazolline derivatives including compounds such as cocampodiacetate, betaines including compounds such as cetyl betaine, surfactant quaternaries including compounds such as dialkyl dimethyl ammonium chloride, amphoteric surfactants such as $C_{12-14}$ alkoxypropyl iminodiproprionate, sulfonate surfactants such as ammonium xylenesulfonate, alkyl sulfate surfactants such as ammonium lauryl sulfate; ether carboxylate surfactants such as butoxy ethyl acetate; sarcosine surfactants such as cocoyl sarcosine; isethionates surfactants such as ammonium cocoyl isethionate; phosphoteric surfactants such as ammonium dicarboxyethylcoco phosphoethyl imidazoline; phosphate ester surfactants such as lauryl ether phosphate ester. The cleaning surfactant used in the aqueous shower rinsing solution, as extensively exemplified immediately above, is a liquid having solvent properties at room temperature and a pH in the range of 4–6.

When small quantities of super wetting surfactants are used in combination with the cleaning surfactant to prevent streaking on shower surfaces, the amount of the super wetting surfactant component is generally 0.5% by volume or less. Non-limiting examples of super wetting surfactants include a silicone glycol copolymer, such as Q2-5211 commercially available from Dow Corning, and a pyrrolidone, such as N-octyl pyrrolidone.

Other chelating agents, such as, but not limited to, ethylene diamine tetraacetic acid (EDTA), hydroxyethyl ethylene diaminetriacetic acid (HEEDTA), diethylenetriamine pentaacetic acid (DTPA), and nitrilotriacetic acid (NTA), and salts thereof, can be substituted for the chelating property of the anionic surfactant N-acyl-N,N'-ethylene diamine triacetic acid on an equivalent chelating strength basis. Thus, these chelating agents can be combined with the surfactants discussed above to provide the combined surfactant and chelating properties associated with N-acyl-N,N'-ethylene diamine triacetic acid.

On an equivalent chelating strength basis, the other chelating agents mentioned above, as well as a solution of diammonium EDTA, can be mixed in the aqueous shower rinsing composition in an amount of about 0.1 to 3% by volume. There is too much residual left on the shower surfaces when the amount of chelating agent in the aqueous shower rinsing composition is above about 3% by volume whereas below 0.1% by volume of chelating agent, there is little or no removal of shower deposits. Another disadvantage of having less than 0.1% by volume of chelating agent in the aqueous rinsing composition is that the shower surfaces, including the shower floor, are made very slippery by the cleaning surfactant in the absence of a suitable amount of chelating agent.

Ammonium hydroxide or morpholine are preferred examples of a base that can be used to increase the pH of the aqueous shower rinsing solution depending on the acidity of the surfactant and the chelating agent. The pH of the aqueous shower rinsing solution is preferably in the range of about pH 4 to 6. Below a pH of about 4, the solubility of the chelating agent in the aqueous rinsing composition is poor, whereas above a pH of about 6, the aqueous rinsing composition does not perform satisfactorily in removing shower deposits.

Small quantities of disinfectant compounds may be used to enhance the effect of chelants in chelating metal ions and inhibiting the growth of microorganisms such as bacteria, mildew and fungi. Non-limiting examples of these disinfectant compounds include dimethyl oxazolidine, cocoamidopropyl betaine, 1,3 bis(hydroxymethyl)-5,5-dimethylhydantoin, orthophenyl phenol, etc.

The aqueous rinsing solution also preferably contains fragrance to provide a fresh and clean smell. Although the addition of fragrance is optional, it satisfies the expectation of consumers that a clean shower would smell "fresh and clean". However, a composition which lacks a fragrance additive still performs satisfactorily in cleaning the tub and shower surfaces.

Pine odor #82555 and Fresh and Clean odor #82556 (AFF, Marietta, Ga.) are commercially available and both are equally acceptable as the preferred fragrance. However, any of a number of commercially available fragrances or odor additives may be used to provide a fresh and clean smell and is well within the skill of those in the art. Generally, 0.0005% to 0.008% of fragrance additive is mixed with the aqueous rinsing solution composition based on the initial concentration of the fragrance additive supplied by the manufacturer.

The water used in this aqueous rinsing solution composition of the present invention must have negligible amounts of metal ions and be capable of not leaving any residue or deposit on evaporation from a shower surface. Distilled water or deionized water is preferred as the source of water for dilution of the individual components as well as for the water added as the balance of the composition for an aqueous shower rinsing solution.

Local conditions, such as the degree of water hardness, altitude above sea level, and the composition of typical soils, may be taken into consideration in formulating the aqueous shower rinsing composition. The amount of surfactant and/or chelating agent may be increased to account for greater water hardness and soils with higher calcium and magnesium levels. At higher altitudes, alcohols having lower vapor pressure can desirably be used. The viscosity of the aqueous shower rinsing composition is preferably below 20 centipoise to minimize formation of residual film on shower surfaces.

The aqueous shower rinsing composition is a dilute surfactant solution containing additional additives and is used after showering to prevent the build-up of deposits on shower surfaces. The shower rinsing solution is best sprayed onto the shower surfaces with a pump or pressurized sprayer and, for best results, the shower rinsing solution is applied to wet shower surfaces before the deposits dry and set. While the rinsing solution does soften and remove dried deposits, its principal benefit is the removal of the deposits that are still wet. After application of the rinsing solution to the wet shower surfaces, the rinsing solution transports these undesirable deposits down the wet shower surfaces by gravity and into the shower drain. In subsequent showers, the water and mist from showering enhances the removal of deposits. Thus, a single cycle or repeated cycles of showering, spray application and drying of shower surfaces, especially when later followed by the next cycle beginning with the next showering, serve to convey deposits down to the shower drain in a semi-continuous fashion. Water rinsing following spraying can be done, but is unnecessary. No scrubbing, wiping, or other mechanical action is necessary, in contrast to conventional cleaning agents which are used to remove deposits only after such deposits have dried.

Previously accumulated build-up of undesirable deposits that have already dried and set can be softened and completely removed, albeit gradually, with continued application of the rinsing solution after each shower. While no wiping or other mechanical action is required to remove such previously dried and set deposits, gentle wiping accelerates the removal of softened deposits that have accumulated over a period of time. Wiping or even scrubbing are permissible, but unnecessary. This aqueous shower rinsing composition is not a shower or tub cleaner in the conventional sense, but is a rinsing solution for maintaining a clean shower.

Furthermore, in contrast to simply rinsing the shower surfaces with plain tap water or soapy water, both of which leave deposits, the present invention prevents streaking and air-dries spot free. Thus, the present aqueous rinsing solution provides a product for maintaining tubs and showers clean with the minimum of effort. This solution is also effective in maintaining bathtub surfaces and the like clean and spot-free even in the absence of a shower. As yet another use besides removing shower deposits and keeping showers clean, the aqueous shower rinsing solution can be applied as described above to provide a pleasant sheen, such as a light matte finish or semi-gloss sheen, to the shower surfaces when dry.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. An aqueous rinsing solution for keeping showers and tub surfaces clean, comprising:

0.5 to 3% by volume of an anionic surfactant capable of chelating metal ions which is N-acyl-N,N',N'-ethylene diamine triacetic acid or a diammonium salt thereof;

1 to 8% by volume of an alcohol selected from the group consisting of isopropyl alcohol, ethyl alcohol, n-propyl alcohol, n-butyl alcohol, isobutyl alcohol, ethylene glycol, propylene glycol isopropyl ether of ethylene glycol, ethyl ether of ethylene glycol, glycerol, and mixtures thereof; and water, wherein said aqueous rinsing solution has a pH in a range of 4 to 6.

2. The aqueous rinsing solution in accordance with claim 1, wherein the aqueous rinsing solution consists essentially of:

about 4.4% by volume isopropyl alcohol;

about 1.5% by volume diammonium salt of N-acyl-N,N'-ethylene diamine triacetic acid;

about 0.1% N-octyl pyrrolidone;

about 0.002% alkyl dimethyl benzyl ammonium chloride;

about 0.002% fragrance additive; and water.

3. The aqueous rinsing solution in accordance with claim 1, wherein said alcohol is propylene glycol.

4. The aqueous rinsing solution in accordance with claim 1, wherein said alcohol is isopropyl alcohol.

5. The aqueous rinsing solution in accordance with claim 1, further comprising 0.5% by volume or less of a super wetting surfactant.

6. The aqueous rinsing solution in accordance with claim 5, wherein said super wetting surfactant is selected from the group consisting of silicone glycol copolymers and pyrrolidone compounds.

7. The aqueous rinsing solution in accordance with claim 1, wherein said water is distilled or deionized water.

8. The aqueous rinsing solution in accordance with claim 1, further comprising a disinfectant compound.

9. The aqueous rinsing solution in accordance with claim 8, wherein said disinfectant compound is selected from the group consisting of alkyl dimethyl benzyl ammonium chloride, dimethyl oxazolidine, cocoamidopropyl betaine, 1,3,-bis (hydroxymethyl)-5,-5-dimethylhydantoin, and orthophenyl phenol.

10. The aqueous rinsing solution in accordance with claim 1, further comprising a base for adjusting the pH.

11. The aqueous rinsing solution in accordance with claim 6, wherein said super wetting surfactant is N-octyl pyrrolidone.

12. The aqueous rinsing solution in accordance with claim 10, wherein said base is selected from the group consisting of ammonium hydroxide and morpholine.

* * * * *